US005852763A

United States Patent [19]

Okuda et al.

[11] Patent Number: 5,852,763

[45] Date of Patent: Dec. 22, 1998

[54] IMAGE HEATING APPARATUS

[75] Inventors: Kouichi Okuda; Yasumasa Ohtsuka, both of Yokohama; Yohji Tomoyuki, Ichikawa; Akira Hayakawa, Tokyo; Manabu Takano, Tokyo; Daizo Fukuzawa, Tokyo; Atsuyoshi Abe, Yokohama, all of Japan

[73] Assignee: Canon Kabushiki Kaisha, Tokyo, Japan

[21] Appl. No.: 844,624

[22] Filed: Apr. 21, 1997

Related U.S. Application Data

[63] Continuation of Ser. No. 234,957, Apr. 28, 1994, abandoned.

[30] Foreign Application Priority Data

Apr. 28, 1993 [JP] Japan ..... 5-125042

[51] Int. Cl.[6] ..... G03G 15/20

[52] U.S. Cl. ..... 399/329; 399/331; 399/333

[58] Field of Search ..... 399/329, 331, 399/333; 219/216, 469

[56] References Cited

U.S. PATENT DOCUMENTS 5,148,226 9/1992 Setoriyama et al. ..... 355/290

5,300,999 4/1994 Koh et al. ..... 355/289

5,365,314 11/1994 Okuda et al. ..... 355/285 X

FOREIGN PATENT DOCUMENTS 63-313182 12/1988 Japan .

2-157878 6/1990 Japan .

2-157883 6/1990 Japan ..... 355/290

4-44075 2/1992 Japan .

4-204890 7/1992 Japan .

*Primary Examiner*—Nestor R. Ramirez

*Attorney, Agent, or Firm*—Fitzpatrick, Cella, Harper & Scinto

[57] ABSTRACT

An image heating apparatus includes a heater; a film having a side for sliding movement relative to the heater through a lubricant and another surface contactable to a recording material carrying an image; driving member for driving the film in contact therewith; and wherein when the heater is not effecting its heating operation, a friction between the film and the driving member is smaller than a friction between the film and the heater.

35 Claims, 6 Drawing Sheets

IMAGE HEATING APPARATUS

This application is a continuation of application Ser. No. 08/234,957 filed Apr. 28, 1994, now abandoned.

FIELD OF THE INVENTION AND RELATED ART

The present invention relates to an image heating apparatus usable with an image forming apparatus such as a copying machine, a laser beam printer or the like, more particularly to an apparatus for supplying heat to an unfixed image on a recording material through a film in sliding contact with the heater.

A heating apparatus of a film heating type in which a material to be heated is urged to a heater through a heat resistive film therebetween, and is moved on the heater together with the film, so that the heat from the heater is transferred to the member to be heated through the film, is disclosed in Japanese Laid-Open Patent Applications Nos. 313182/1988, 157878/1990, 44075/1992, 204980/1992 and so on. Such a heating apparatus is usable with an image forming apparatus such as a copying machine, a laser beam printer, a facsimile machine, a microfilm reader printer, an image display device, a recording apparatus and so on. An unfixed toner image (to be fixed) corresponding to image information is formed through direct or indirect (transfer) process on a surface of a recording material (electrofax sheet, electrostatic recording sheet, transfer sheet or printing paper) as an image carrying material, using toner comprising heat fusible resin material or the like through an image formation process means such as electrophotographic, electrostatic recording or magnetic recording or the like. The apparatus is usable as an image heating and fixing apparatus for fixing the toner image on the recording material surface as a permanent fixed image.

The use of the apparatus of this invention is not limited to the image fixing apparatus. For example, it is usable with an apparatus for improving the surface property of the image by heating a recording material carrying an image, an apparatus for temporarily fixing an image, or another means or apparatus for heating a member to be heated.

The film heating type heating apparatus is advantageous over known heat roller type, heat plate type, belt heating type, flash heating type, oven heating type or the like (1) in that the heater is permitting to have low thermal capacity film of small thickness, and therefore, the power saving and waiting time reduction (quick start) are possible, and temperature rise in an image forming apparatus can be suppressed, (2) in that the fixing point and the separation point can be selected separately, and therefore, the toner offset can be effectively prevented. The film heating type is advantageous over the known system in other various respects.

In the film heating type heating apparatus, in order to reduce the sliding friction resistance between the heater and an inside surface of the heat resistive film relative to which the heater surface slides, a lubricant is between the surface of the heater and the film inside surface.

The lubricant is not a low viscosity one such as oil, but a high viscosity material such as grease to prevent escape thereof. However, when the grease lubricant is used, the viscosity is high in a room temperature condition (when the heater is not actuated), the lubricant functions as a paste between the surface of the heater and the film inside surface with the result of large friction F2 between the heater surface and the film inside surface.

When the heater is operated, the grease lubricant is heated and therefore the viscosity thereof lowers so that the friction F2 reduces to permit smooth relative movement between the film inside surface and heater surface, thus functioning as a lubricant.

As will be understood from the foregoing, a driving torque when the film is moved after the apparatus is started with non-heated state. Therefore, the driving system is required to have a high driving torque. In addition, the high torque results in too high force to the film with the possible result of deformation or tearing of the film. In addition, the driving gear may be damaged.

SUMMARY OF THE INVENTION

Accordingly, it is a principal object of the present invention to provide an image heating apparatus in which the film is prevented from tearing, and another member is prevented from being damaged, upon driving of the film.

It is another object of the present invention to provide an image heating apparatus in which a torque of a driving member for driving the film is reduced.

It is a further object of the present invention to provide an image heating apparatus in which when the heater is not operated, the friction between the film and the driving member is smaller than the friction between the film and the heater.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 3, (b) is a graph showing a relationship between a heater temperature and a driving torque.

FIG. 4, (b) is a graph showing a relation between time from apparatus driving start and the driving torque.

FIG. 6, (b) is a sectional view of an image heating apparatus according to a further embodiment of the present invention.

DESCRIPTION OF THE PREFERRED EMBODIMENTS

Referring to the accompanying drawings, the embodiments of the present invention will be described.

Figure 1:
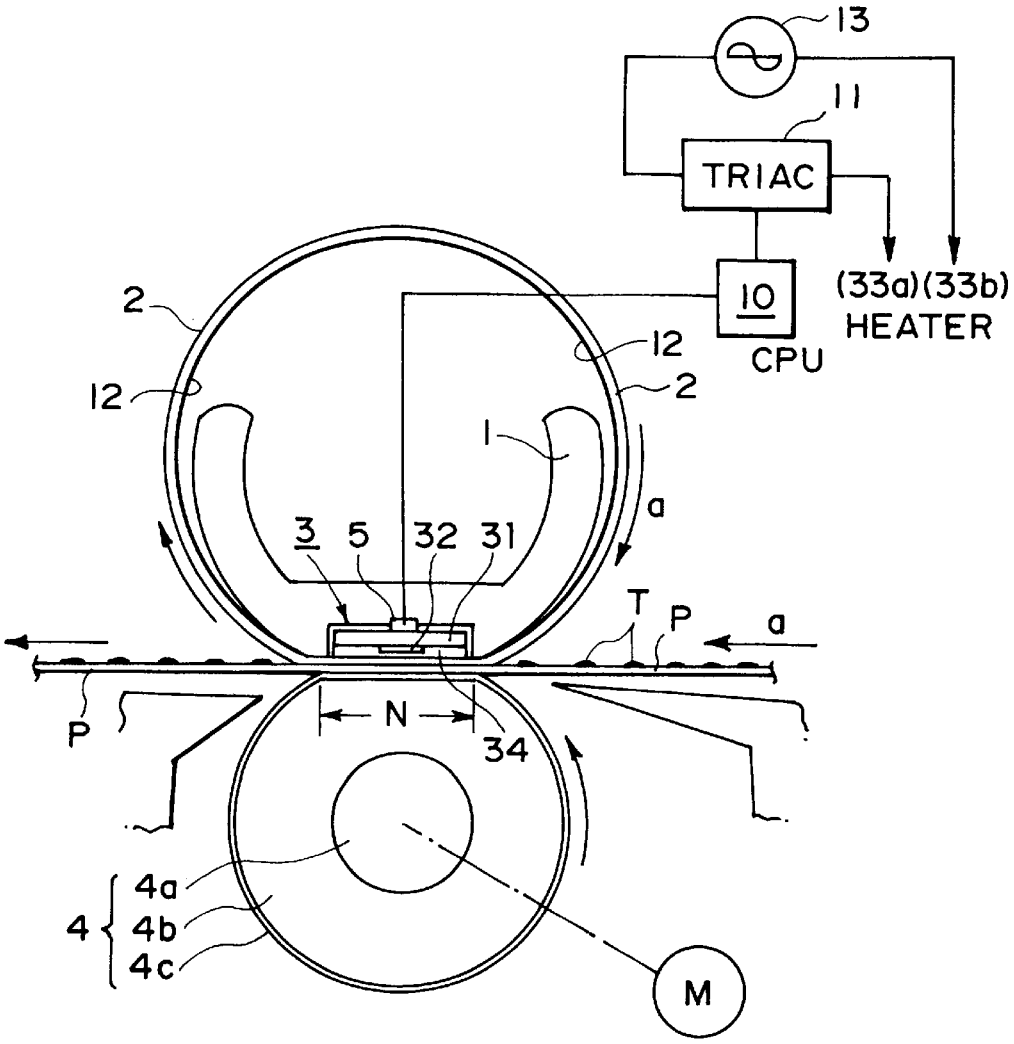
FIG. 1 is a sectional view of an image heating apparatus according to an embodiment of the present invention.

FIG. 1 shows structures of an example of an image forming apparatus incorporating an image heating and fixing apparatus according to an embodiment of the present invention. The image forming apparatus is an original carriage reciprocating type, rotatable drum type, image transfer type and process cartridge type electrophotographic copying machine.

Designated by a reference numeral 100 is a casing of the apparatus. A reciprocable original carriage 101 is disposed on a top plate 102 of the casing and comprises transparent member such as glass plate. It is reciprocable at a predetermined speed on the top plate 102 in a direction a and a'. Designated by a reference character G is an original to be copied, and is placed face down on the original supporting carriage at a predetermined reference position. The original is covered with an original cover 103. Designated by a reference numeral 104 is a slit opening as an original illuminating portion, extending in a direction (perpendicular to the sheet of the drawing) perpendicular to the reciprocal movement direction of the original carriage 101, on the top plate 102.

The image surface of the original G on the original carriage 101 passes by the opening 104 during the forward stroke (rightward a) stroke of the reciprocal movement of the original carriage. During this, the light L of the lamp 105 illuminates the original through the slit opening 104 and through a transparent original carriage 101. The light reflected by the original is imaged on the surface of the photosensitive drum 107 through an image forming element array 106.

The photosensitive drum 107 comprises a photosensitive layer of zinc oxide photosensitive layer or organic photoconductor photosensitive layer or the like. It is rotated at a predetermined peripheral speed about a central shaft 108 in a direction indicated by an arrow b (clockwise direction). During the rotation, it is uniformly charged to a positive or negative polarity by a charger 109. The uniformly charged surface is exposed to the image light of the original through the slit, so that an electrostatic latent image corresponding to an original image is formed on the photosensitive drum 107 surface.

The electrostatic latent image is visualized with toner comprising resin material which is softened and fused by heating, by a developing device 110. The visualized toner image is carried on the photosensitive member to a transfer station having a transfer charger 11.

Designated by a reference character S is a cassette accommodating transfer material sheets P. The sheet in the cassette is fed out one-by-one by rotation of a pick-up roller 112. Then, it is fed out by a registration roller 113 in such a synchronized timing that when a leading edge of the toner image reaches the transfer discharger 111, the leading edge of the transfer sheet P reaches to between the transfer charger 111 and the photosensitive drum 107.

The toner image is sequentially transferred from the photosensitive drum 107 to the sheet by the transfer discharger 111.

The sheet having the transferred toner image is separated from the photosensitive drum 107 surface by an unshown separating means, and is subjected to an image heating and fixing operation by an image fixing apparatus 115, by a conveying device 114. Then, it is discharged as a copy by discharging rollers 116 to a discharge tray 117.

The surface of the photosensitive drum 107 after the image transfer, is cleaned by a cleaning device 118 so that residual toner or other contamination are removed.

Designated by PC is a process cartridge detachably mountable to a main assembly 100 of the apparatus. In this embodiment, it comprises four process means, namely a photosensitive drum 107 as an image bearing member, a charger 109, a developing device 110 and a cleaning device 118. The process cartridge is detachably as a whole mountable to the main assembly of the image forming apparatus.

Figure 2:
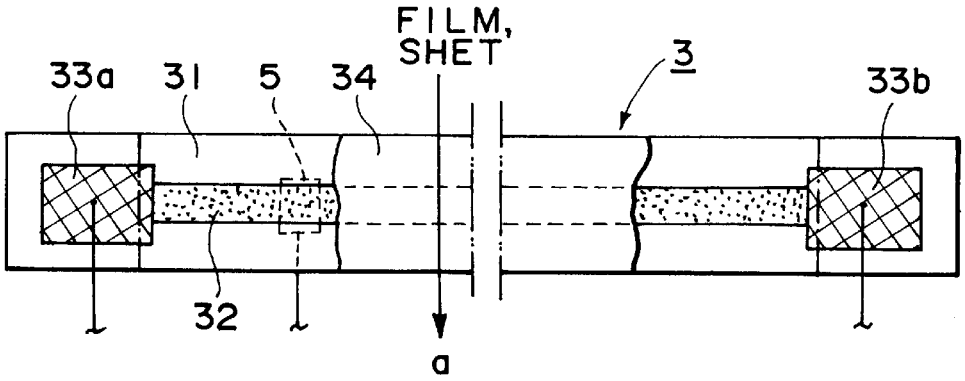
FIG. 2 is a top plan view of a heater.

Referring to FIG. 1, there is shown an exemplary image heating fixing apparatus of the film heating type. FIG. 2 is a schematic top plan view partly broken.

This is a so-called tensionless type apparatus in which an endless belt or cylindrical film is used as a heat resistive film. At least a part of the film is always tension free, and the film is driven by a driving force of the pressing member.

Referring to FIGS. 1 and 2, the description will be further made.

An endless heat resistive film is extended around a stay 1, functioning as a film guide, and including a heater 3. An internal circumferential length of the heat resistive film and an outer circumferential length of the stay 1 including the heater 3 is such that the internal circumferential length of the film 2 is larger by approx. 3 mm, so that the film 2 is loosely extended around the stay 1.

In order to improve the quick start property by reduction of the thermal capacity, the thickness of the film 2 is preferably not more than 100 $\mu$m, preferably not more than 50 $\mu$m and not less than 20 $\mu$m. It may be a single layer film of PTFE, PFA, FEP or the like, or a multi-layer film of polyimide, polyamide, PEEK, PES, PPS or the like coated on the outer periphery thereof with PTFE, PFA, FEP or the like. In this embodiment, the outer surface of a polyimide film is coated with PTFE material.

The heater 3 comprises an elongated heat resistive, electrically insulative and high thermal conductivity base plate 31, extending in a direction substantially perpendicular to a feeding direction a of the recording material (material to be heated) or the feeding direction of the heat resistive film 2, a heat generating resistor 32 formed along a length of the base plate in the central portion on the front surface of the base plate, a heat resistive coating layer 34 for protecting the surface of the heater having the heat generating resistor, power supply electrodes at the opposite longitudinal ends of the heat generating resistor 32 (33*a*, 33*b* in FIG. 2), a temperature detecting element 5 such as thermister or the like for detecting the heater temperature, provided on the backside of the base plate. Thus, the heater is a low thermal capacity linear heater.

The surface having the heat generating resistor 32 is placed face down to a bottom portion of the stay 1 having the rigidity and heat resistive property, by which the heater is fixed in the stay 1.

The base plate 31 is of alumina or aluminum nitride or the like having a thickness of 1 mm, a width of 10 mm and a length of 240 mm.

The heat generating resistor 32 is of Ag/Pd (silver palladium), $RuO_2$, $Ta_2N$ or another electric resistor material, printed with a thickness of approx. 10 $\mu$m and a width of 1–3 mm as a line or fine stripe through screen printing or the like.

Power supply electrodes 33*a* and 33*b* are printed by screen printing using Ag or the like. The coating layer 34 is of heat resistive glass having a thickness of approx. 10 $\mu$m, for example.

A pressing roller 4 forms a nip (fixing nip) N with a film 2 interposed therebetween. The pressing roller also functions to rotate the film 2 by contact to the outer surface of the film.

The pressing roller 4 comprises a core metal 4*a*, a heat resistive rubber layer 4*b* having a high parting property, such as silicone rubber or the like, and an outermost low friction layer 4*c*. It is urged toward the surface of the heater 3 by unshown bearing means or urging with a predetermined pressing force. It is driven in the indicated counterclockwise direction by driving means M.

By the friction between the roller and the film outer surface the film 2 is rotated when the pressing roller 4 is rotated.

A low friction layer 4*c* is in the form of a tube or coating of a fluorine resin such as PFA, PTFE, FEP, ETFE or the like having a thickness of approx. 1–100 $\mu$m, or a tube or coating of fluorinated rubber, silicone rubber or another heat resistive rubber in which the fluorine resin material are dispersed.

The temperature of the heater 3 increases by heat generation over the entire longitudinal length of the heat generating resistor 32 by power supply to the electrodes 33*a* and 33*b* of the heat generating resistor 32. The temperature is detected by a temperature detecting element 5. The output of the temperature sensor 5 is A/D-converted, and is supplied to a CPU 10. On the basis of the information, the electric power supply to the heater is controlled through phase and/or wave number control or the like for an AC voltage of an AC voltage source 13 for supplying electric power to the heat generating resistor 32, using triac 11 or the like. Thus, the temperature of the heater 3 is controlled.

When the temperature sensor 5 detects a temperature lower than a predetermined temperature, the electric power is controlled to increase the temperature of the heater 3, and when the temperature is high, the electric power is controlled to decrease the temperature of the heater, and therefore, during the fixing operation, the temperature of the heater 3 is maintained constant.

The inside surface of the heat resistive film 2 of the endless belt is coated with a highly heat resistive grease 12 such as fluorine grease as a lubricant.

Figure 3A:
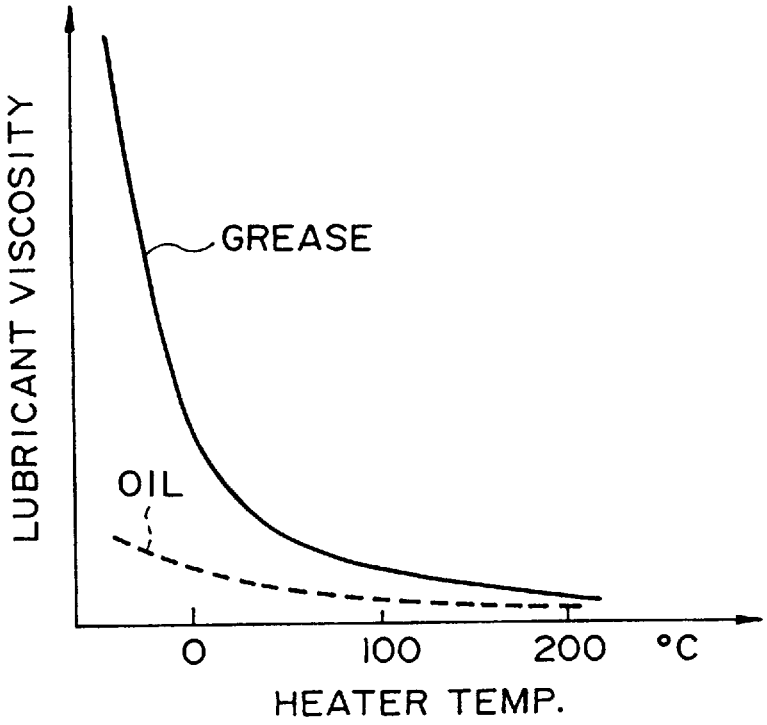
FIG. 3, (a) is a graph showing a relationship between a heater temperature and a lubricant viscosity.
Figure 3B:
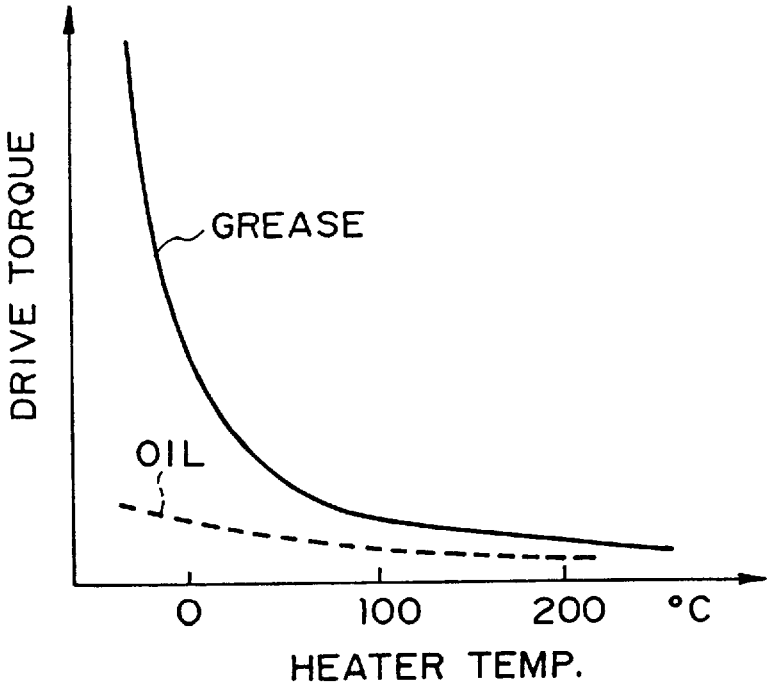

As shown by a solid line in FIG. 3, (a), the viscosity of the grease 12 quite high under low temperature, and is low under high temperature. The viscosity of an oil is low from the beginning as indicated by a broken line, and the viscosity change range with respect to temperature is small. If this is used as a lubricant, the lubricant flows out during use, so that the lubricancy is soon lost. Therefore the grease is used as the lubricant since it is usable for a long period of time.

However, the grease 12 exhibits a quite high viscosity under a low temperature, and therefore, when the heater is not operated, the inside surface of the film 2 and the surface of the heater 3 are adhered by the high viscosity grease 12. As a result, the driving torque required to start the apparatus is large, as shown in FIG. 3, (b). With the decrease of the viscosity by temperature rise, the grease 12 exhibit sufficient lubricant function, thus reducing the driving torque.

In this embodiment, a friction force F1 between the outer peripheral surface of the film 2 and the pressing roller 4 as a driving member contacted to an outer surface of the film, and a friction force F2 between an inside surface of the film 2 and the surface of the heater 3, satisfy F1<F2 when the heater does not effect the heating operation, by the low friction layer 4*c* which is an outer layer of the pressing roller 4 having a proper friction coefficient relative to the outer surface of the film.

Figure 4A:
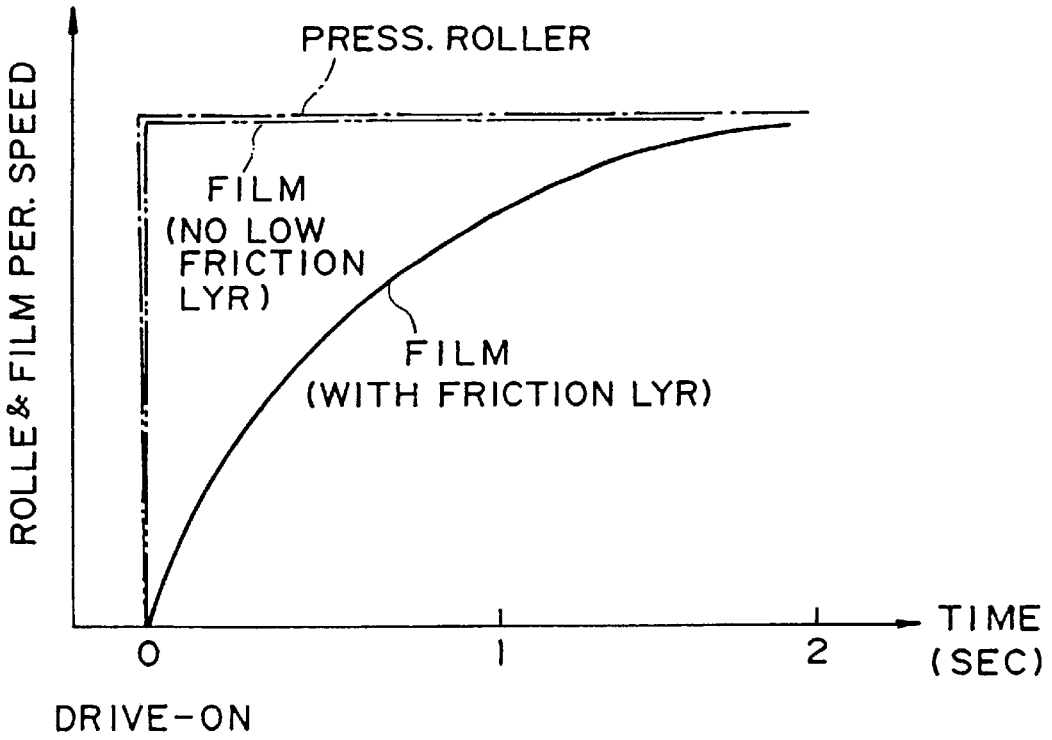
FIG. 4, (a) is a graph showing a relationship between the time elapsed from actuation of the apparatus drive and a peripheral speeds of a pressing roller and a film.
Figure 4B:
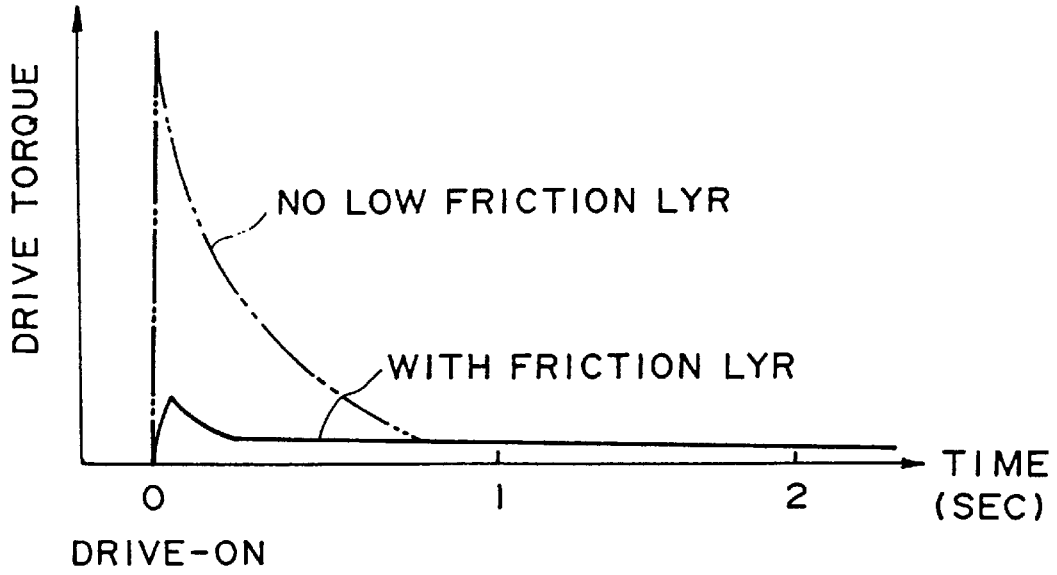

By providing a low friction layer 4*c* at the outer surface of the pressing roller 4 for driving the film 2, as shown in FIG. 4, (a) and (b), when the heater temperature is low (room temperature) immediately after the apparatus is actuated, the pressing roller rotates slipping relative to the outer surface of the film 2 because F1<F2, so that the driving torque is reduced. After a period of time elapses so that the heater temperature increases, the viscosity of the grease 12 lowers with the result that the friction F2 between the inside surface of the film 2 and the heater 3 surface decreases so that F1<F2 is satisfied. Then, the slippage between the outer surface of the film 2 and the pressing roller 4 does not occur. In this state, the friction between the pressing roller 4 and the film outer surface is effective to start to drive the film 2 smoothly in the indicated clockwise direction. In addition, the driving torque of the apparatus is lowered.

When the temperature of the heater increases to a predetermined level and peripheral speed of the film 2 by the pressing roller 4 is stabilized, a recording material as the member to be heated to be subjected to the image fixing operation is in produced between the film 2 and the pressing roller 4 in a nip N formed by the heater 3 and the pressing roller 4 with the film 2 interposed therebetween, from an unshown image forming station. The recording material is nipped and fed with the film 2, during which the sheet from the heater 3 is applied to the recording material 2 through the film 2, so that the unfixed visualized image (toner image) T is heated and fixed on the recording material P surface. The recording material P passing through the nip N is separated from the surface of the film 2 and is further fed. As described in the foregoing, when the driving torque reduces under the low temperature, long term drive is enabled under unheated, is enabled. Therefore, when the apparatus is driven without function of the fixing operation, as in the case when a jammed sheet is forcedly discharged, for example, the operation is possible without supplying power to the heater 3, thus reducing the power consumption.

Thus, according to the present invention, the film is not prevented from being subjected to an excessive tension when the temperature of the heater is not high, and therefore, the damage of the film itself can be prevented. In addition, the reduction of the required driving torque is effective to reduce the cost of the driving system and effective to prevent the damage of the apparatus.

The description will be made as to another embodiment. The apparatus of this embodiment is similar to that of the forgoing embodiment, and the description will be made as to the different portions.

Figure 5:
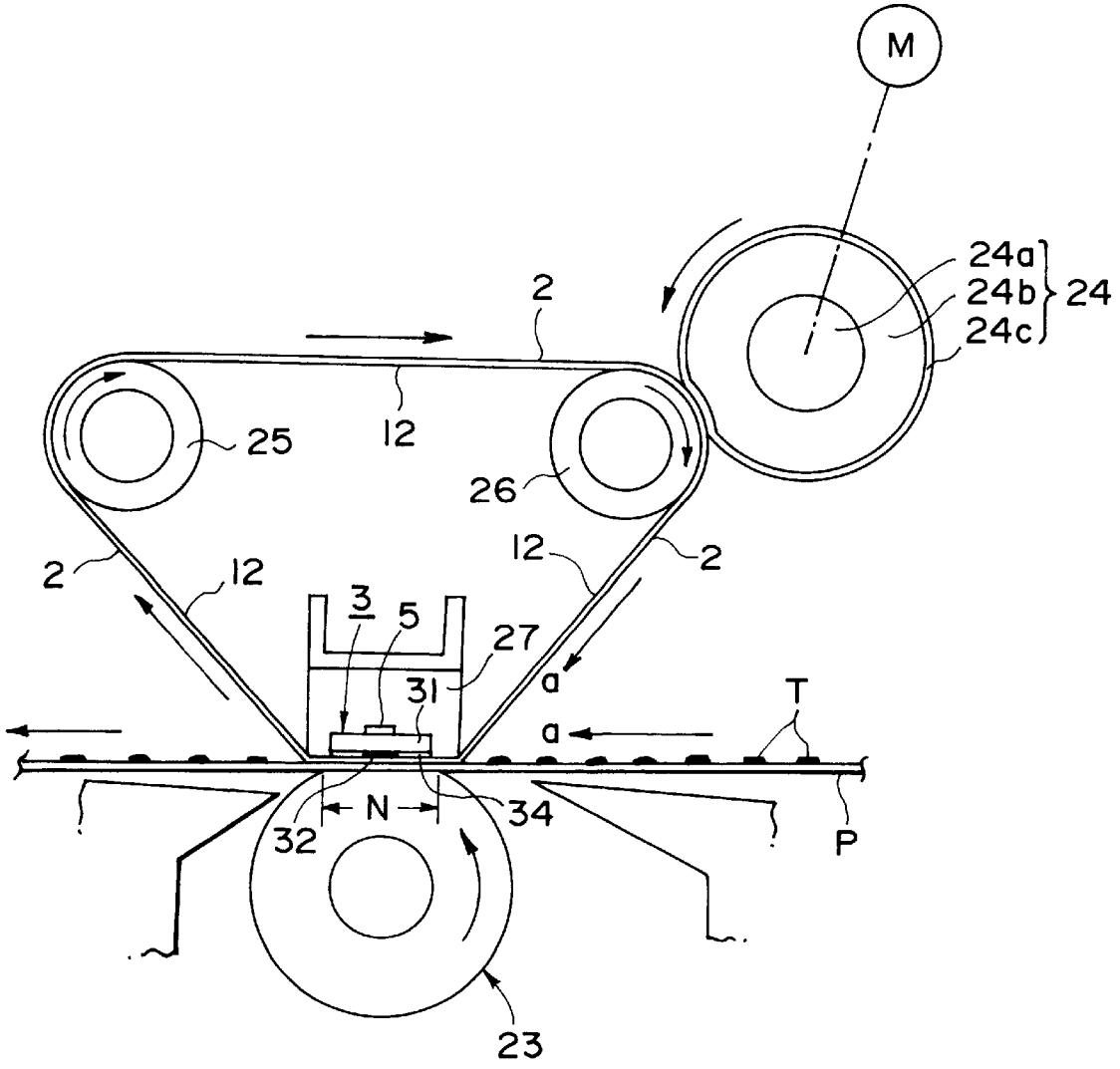
FIG. 5 is a sectional view of an image heating apparatus according to another embodiment of the present invention.

The apparatus of this embodiment shown in FIG. 5 is a film tension type apparatus, and three parallel members, namely, the first and second follower rollers 25 and 26 and a heater fixed to a heater support 27 of heat resistive and heat insulating property, are provided, around which an endless heat resistive film 2 is extended.

The internal surface of the film 2 is coated with grease 12 as lubricant.

Designated by a reference numeral 23 is a pressing roller urged to the heater with the film 2 therebetween. In this embodiment, it is a follower roller rotated by the film 2.

Designated by a reference numeral 24 is a film driving roller contacted to the outer surface of the film urged to the follower roller 26 with the film 2 therebetween. When the roller 24 is rotated in the counterclockwise direction by driving means M, the film 2 is rotated in the clockwise direction. With the rotation of the film, the rollers 25, 26 and 23 are rotated thereby.

Similarly to the pressing roller 4 contacted to the outer surface of the film in the foregoing embodiment, the driving roller 24 comprises a core metal 242, a heat resistive rubber layer 24*b* having a high parting property such as silicone rubber or the like, an outermost low friction layer 24*c*. When the heater 3 is not operated, F1<F2 is satisfied by properly selecting the friction coefficient between the low friction layer 24*c* and the film outer surface.

This embodiment is also advantageous similarly to the foregoing embodiment.

In the apparatus of FIGS. 1 and 5, the outermost low friction layer 4*c* and 24*c* of the pressing roller 4 or the driving roller 24 (contacted to the outer surface of the film) comprises fluorine resin, and therefore, has a high parting property, so that they are not easily contaminated with toner.

When the film 2 is driven at the outer surface, the toner offset to the film 2 is deposited on the driving roller and then is removed onto the recording material P with the result of image contamination, as a possible problem. This can be avoided according to the present invention.

A further embodiment will be described. This embodiment is fundamentally similar to the foregoing embodiment, and therefore, the description will be made as to different portions.

Figure 6A:
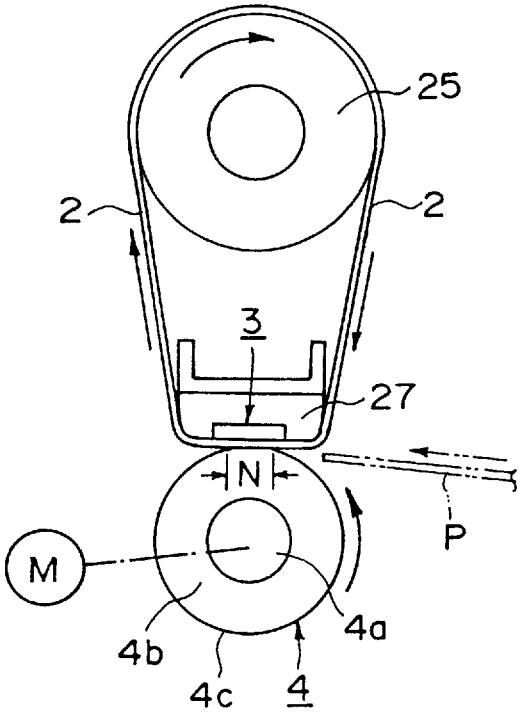
FIG. 6, (a) is a sectional view of an image heating apparatus according to a further embodiment of the present invention.
Figure 6B:
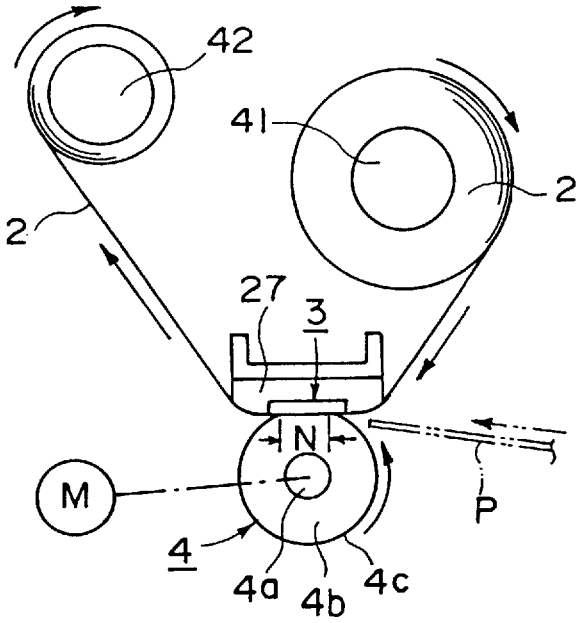
Figure 7:
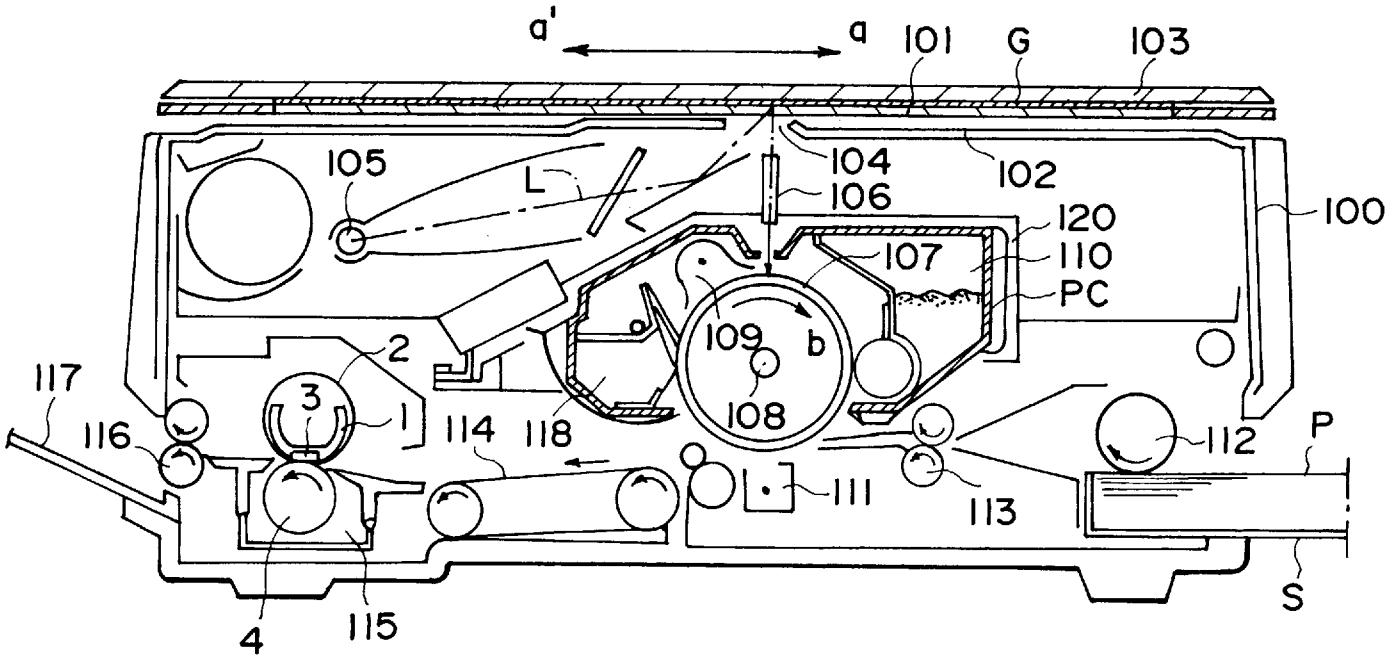
FIG. 7 is a sectional view of an image heating apparatus using the present invention.

FIG. 6, (a) and (b) illustrates a heating apparatus of a film heating type. In (a), a heat resistive film is extended around the heater 3 and the follower roller 25. A pressing and driving roller 4 contacted to the outer surface of the film is urged to the heater 3 with the film 2 therebetween, and the film is driven by the driving roller 4.

In (b), the heat resistive film 2 is in the form of a roll rather than endless belt. Therefore, the heat resistive film 2 of this embodiment is a non-endless film. This is bridged between a supply shaft 41 and a take-up shaft by way of a heater 3. The film is also driven by a pressing and driving roller 4 press-contacted to the outer surface of the film toward the heater 3 with the film 2 therebetween.

The driving roller of the two apparatuses, have the same structure as the driving roller 4 of FIG. 1 embodiment. More particularly, the friction coefficient between the outermost low friction layer 4*c* and the film outer surface is selected so as to satisfy $F1<F2$ during non-heating-operation of the heater 3.

The same advantageous effects as in the foregoing embodiments, can be provided in this embodiment.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus, comprising:

a heater;

a film having a first side for sliding movement relative to said heater through a lubricant and a second side contactable to a recording material carrying an image; and a driving member for driving said film in contact therewith;

wherein a friction between said film and said driving member is smaller than a friction between said film and said heater when said heater is not in its heating operation and said driving member is contacted to said film without a decrease of pressure.

2. An apparatus according to claim 1, wherein said driving member is contactable to the second side of said film contactable to the recording material.

3. An apparatus according to claim 1, wherein said driving member has a low friction layer on a surface contactable to said film.

4. An apparatus according to claim 3, wherein said low friction layer comprises a rubber layer containing fluorine resin or a fluorine resin layer.

5. An apparatus according to claim 1, wherein during heating operation of said heater, a friction between said film and said driving member is larger than a friction between said film and said heater.

6. An apparatus according to claim 1, wherein said film is cylindrical, and said driving member is a pressing roller cooperating with said heater to form a nip with said film therebetween.

7. An apparatus according to claim 1, wherein said film is an endless film, and said apparatus comprises a follower roller for stretching said film.

8. An apparatus according to claim 7, wherein said driving member is a pressing roller for cooperating with said heater to form a nip with said film therebetween.

9. An apparatus according to claim 1, wherein said film is a non-endless film fed out from a supply shaft and taken up by a take-up shaft, and said driving member is a pressing roller for forming a nip with said film therebetween.

10. An apparatus according to claim 1, wherein the lubricant is a grease.

11. An image heating apparatus, comprising:

a heater;

a film having a first side for sliding movement relative to said heater through a lubricant and a second side contactable to a recording material carrying an image; and driving member for driving said film in contact therewith;

wherein said driving member has a low friction layer on a surface contactable to said film, and wherein when said heater is not effecting its heating operation, a friction between said film and said driving member is smaller than a friction between said film and said heater.

12. An apparatus according to claim 11, wherein said low friction layer comprises a rubber layer containing fluorine resin or a fluorine resin layer.

13. An apparatus according to claim 11, wherein said driving member is contactable to the second side of said film contactable to the recording material.

14. An apparatus according to claim 11, wherein during a heating operation of said heater, a friction between said film and said driving member is larger than a friction between said film and said heater.

15. An apparatus according to claim 11, wherein said film is cylindrical, and said driving member is a pressing roller cooperating with said heater to form a nip with said film therebetween.

16. An apparatus according to claim 11, wherein said film is an endless film and said apparatus further comprises a follower roller for stretching said film.

17. An apparatus according to claim 16, wherein said driving member is a pressing roller for cooperating with said heater to form a nip with said film therebetween.

18. An apparatus according to claim 11, wherein said film is a non-endless film fed out from a supply shaft and taken up by a take-up shaft, and said driving member is a pressing roller for forming a nip with said film therebetween.

19. An apparatus according to claim 11, wherein the lubricant is a grease.

20. An image heating apparatus, comprising:

a heater;

a film having a first side for sliding movement relative to said heater and a second side contactable to a recording material carrying an image; and a driving roller for driving said film in contact therewith, wherein said driving roller has an elastic layer and a surface resin tube layer.

21. An apparatus according to claim 20, wherein said resin tube layer is of fluorine resin material.

22. An apparatus according to claim 21, wherein said fluorine resin material is PFA.

23. An apparatus according to claim 20, wherein said elastic layer is of rubber.

24. An apparatus according to claim 23, wherein said rubber is a silicone rubber.

25. An apparatus according to claim 20, wherein said driving roller is a pressing roller for cooperating with said heater to form a nip with said film therebetween.

26. An apparatus according to claim 20, wherein said film is an endless film.

27. An image heating apparatus, comprising:

a heater;

a film having a first side for sliding movement relative to said heater through a lubricant and a second side contactable to a recording material carrying an image; and a driving member for driving said film in contact therewith;

wherein a friction between said film and said driving member is smaller than a friction between said film and said heater when said lubricant has a high viscosity, and a friction between said film and said driving member is larger than a friction between said film and said heater when said lubricant has a low viscosity.

28. An apparatus according to claim 27, wherein said driving member is contactable to the second side of said film contactable to the recording material.

29. An apparatus according to claim 27, wherein said driving member has a low friction layer on a surface contactable to said film.

30. An apparatus according to claim 29, wherein said low friction layer comprises a rubber layer containing fluorine resin or a fluorine resin layer.

31. An apparatus according to claim 27, wherein said film is cylindrical, and said driving member is a pressing roller cooperating with said heater to form a nip with said film therebetween.

32. An apparatus according to claim 27, wherein said film is an endless film, and said apparatus comprises a follower roller for stretching said film.

33. An apparatus according to claim 32, wherein said driving member is a pressing roller for cooperating with said heater to form a nip with said film therebetween.

34. An apparatus according to claim 27, wherein said film is a non-endless film fed out from a supply shaft and taken up by a take-up shaft, and said driving member is a pressing roller for forming a nip with said film therebetween.

35. An apparatus according to claim 27, wherein the lubricant is a grease.

* * * * *

UNITED STATES PATENT AND TRADEMARK OFFICE

CERTIFICATE OF CORRECTION

PATENT NO. : 5,852,763

DATED : December 22, 1998

INVENTOR(S) : KOUICHI OKUDA, ET AL.

It is certified that error appears in the above-identified patent and that said Letters Patent is hereby corrected as shown below:

COLUMN 2,
Line 45, "speeds" should read --speed--.

COLUMN 3,
Line 45, "sheets" should read --sheet--.

COLUMN 6,
Line 15, "in produced" should read --produced--; and
Line 64, "metal 242," should read --24a,--.

Signed and Sealed this

Thirty-first Day of August, 1999

*Attest:*

Q. TODD DICKINSON

*Attesting Officer*

*Acting Commissioner of Patents and Trademarks*